US011512921B1

(12) United States Patent
Xiao

(10) Patent No.: US 11,512,921 B1
(45) Date of Patent: Nov. 29, 2022

(54) CROSSBOW

(71) Applicant: Shandong Han Shan Composite Material Technology Co., Ltd., Weihai (CN)

(72) Inventor: Riguo Xiao, Weihai (CN)

(73) Assignee: Shandong Han Shan Composite Material Technology Co., Ltd., Weihai (CN)

( * ) Notice: Subject to any disclaimer, the term of this patent is extended or adjusted under 35 U.S.C. 154(b) by 0 days.

(21) Appl. No.: 17/573,365

(22) Filed: Jan. 11, 2022

(30) Foreign Application Priority Data

Nov. 18, 2021 (CN) ..... 202111367210.0

(51) Int. Cl.
*F41B 5/12* (2006.01)
*F41B 5/14* (2006.01)
*F41B 5/00* (2006.01)

(52) U.S. Cl.
CPC ..... *F41B 5/123* (2013.01); *F41B 5/0094* (2013.01); *F41B 5/143* (2013.01)

(58) Field of Classification Search
CPC ..... F41B 5/0094; F41B 5/12; F41B 5/123
See application file for complete search history.

(56) References Cited

U.S. PATENT DOCUMENTS 3,744,473 A * 7/1973 Nishioka ..... F41B 5/0094 124/25.6
4,947,822 A * 8/1990 Jones ..... F41B 5/12 124/25
5,150,699 A * 9/1992 Boissevain ..... F41B 5/0094 124/900
6,273,078 B1 * 8/2001 Schwesinger ..... F41B 5/12 124/16
8,485,170 B1 * 7/2013 Prior ..... F41B 5/0094 124/25
8,863,732 B1 * 10/2014 Prior ..... F41B 5/123 124/25
9,719,749 B1 * 8/2017 Prior ..... F41B 3/005
2014/0290636 A1 * 10/2014 Goehring, III ..... F42B 6/02 124/25
2020/0355458 A1 * 11/2020 Langley ..... F41B 5/1469

* cited by examiner

*Primary Examiner* — John A Ricci
(74) *Attorney, Agent, or Firm* — Bayramoglu Law Offices LLC

(57) ABSTRACT

A crossbow includes a frame, where the frame is provided with an arrow track for placing an arrow; the crossbow includes at least one limb; the limb includes a fixed end and a movable end; the movable end is moved toward the fixed end under pressure, such that two sections bent in opposite directions are formed on the limb to make the limb wave-shaped; the movable end is moved in a reverse direction to make the limb restored; and a primary string of the crossbow is directly or indirectly connected to the movable end of the limb. The limb of the crossbow can generate large elastic potential energy and can reduce the kinetic energy consumed by translation, and avoids the problem of different strokes between multiple limbs. The crossbow prevents the winding wheels from translating to consume the kinetic energy, such that the arrow can gain sufficient kinetic energy.

20 Claims, 11 Drawing Sheets

CROSSBOW

CROSS REFERENCE TO THE RELATED APPLICATIONS

This application is based upon and claims priority to Chinese Patent Application No. 202111367210.0, filed on Nov. 18, 2021, the entire contents of which are incorporated herein by reference.

TECHNICAL FIELD

The present disclosure relates to the technical field of bow and arrow manufacturing, and in particular to a crossbow.

BACKGROUND

At present, the most common crossbows on the market have a four-limb structure. Two pairs of limbs are respectively arranged on the left and right sides of the arrow track, and the movable ends of the two limbs on each side are connected by a winding wheel so that the two limbs have the same stroke. When in use, the primary string is pulled to make the four limbs bent to generate elastic potential energy, and the arrow is shot through the rebound of the four limbs. However, such a shooting process has the following problems. 1. The limbs are usually bent near their fixed ends, where the strain is the greatest, which puts forward high requirements for the limb material. 2. Even if the two limbs are connected and fixed by the winding wheel, it is likely to waste the kinetic energy of the limbs due to the asynchrony of the stroke during the rebound process. 3. When aiming, once the crossbow cracks accidentally, the limbs bent in a forward direction are prone to rebound and directly hit the user's head, causing serious injury. 4. When winding, the user is required to overcome the stiffness of the four limbs and pull the primary string so as to bend the limbs, which is not safe. Besides, if the string is released, the limbs will rebound prematurely, and the user has to spend a lot of effort to wind the string again. 5. When the arrow is shot, the limbs rebound horizontally, and the winding wheels provided at the movable ends of the limbs swing horizontally. The translational motion of the limbs, the translational motion of the winding wheels, the rotation of the winding wheels and the movement of the string all consume the kinetic energy, and reduce the kinetic energy actually gained by the arrow, which reduces the shooting speed of the arrow, and produces a lot of noise on the string.

SUMMARY

In order to overcome the shortcomings of the prior art, the present disclosure provides a crossbow.

In order to solve the above technical problem, that present disclosure adopts the following technical solutions: a crossbow includes a frame, where the frame is provided with an arrow track for placing an arrow; the crossbow includes at least one limb; the limb includes a fixed end and a movable end; the movable end is moved toward the fixed end under pressure, such that two sections bent in opposite directions are formed on the limb to make the limb wave-shaped; the movable end is moved in a reverse direction to make the limb restored; and a primary string of the crossbow is directly or indirectly connected to the movable end of the limb.

Further, winding wheels may be symmetrically arranged on the left and right sides of the arrow track; the winding wheels may be connected to the movable end of the limb through a transmission string; the transmission string may be connected to the primary string through the winding wheels; and a winding direction of the transmission string on the winding wheels may be opposite to that of the primary string on the winding wheels.

Further, the crossbow may be provided with a pre-compression structure; the pre-compression structure may include a worm wheel and a worm; a string receiving wheel may be fixed coaxially with the worm wheel; a secondary string may be wound on the string receiving wheel; the other end of the secondary string may be wound on a guide wheel and the movable end of the limb and then may be fixed, such that the movable end of the limb defines a movable pulley structure; and when the secondary string may be tightened, the movable end of the limb may be driven to move toward the fixed end.

Further, the crossbow may be provided with pre-tensioning wheels; the pre-tensioning wheels each may include a central shaft and at least two guide pulleys; the at least two guide pulleys revolve around the central shaft; an elastic member may be provided on the central shaft; and a corresponding pre-tensioning wheel may be rotated in a reverse direction to generate a restoring force on the elastic member, which has a pre-tensioning effect on the string.

Further, the pre-tensioning wheels may be located on the paths of the transmission string and the secondary string.

Further, a height-adjustable arrow rest may be provided at an exit of the arrow track of the crossbow; the height-adjustable arrow rest may include an arrowhead bracket; the arrowhead bracket may be provided with an arrow groove in a direction close to the arrow track; the arrowhead bracket rotates vertically with a middle part thereof as a fulcrum; and the arrowhead bracket rotates in a first direction to position the arrow groove in the arrow track, and the arrowhead bracket rotates in a second direction to make the arrow groove move away from the arrow track.

Further, the height-adjustable arrow rest may include a take-up wheel; the take-up wheel may be fixed relative to the arrow track, and the take-up wheel may be rotatable; a surface of the take-up wheel may be provided with a slide that spirals upward or downward around a center of the surface; in a direction away from the arrow track, the arrowhead bracket may be provided with a rotatable tip extending to the slide; the tip abuts against the slide and slides along the slide; and when the take-up wheel rotates, the tip rises or falls along the slide, such that the arrow groove of the arrowhead bracket moves away from the arrow track or moves toward the arrow track.

Further, the take-up wheel may be provided with arrow rest control strings that may be respectively wound on the winding wheels on two sides; winding directions of the two arrow rest control strings on the take-up wheel may be opposite; and when the two winding wheels rotate relative to each other, the arrow rest control strings drive the take-up wheel to rotate.

Further, a blocking piece may be provided between a major wheel and a winding wheel shaft of each of the winding wheels; and when the major wheel rotates in a direction, the major wheel may be blocked by the blocking piece and drive the winding wheel shaft to rotate.

Further, an elastic member may be provided between the major wheel and the winding wheel shaft of each of the winding wheels; when the major wheel overcomes a force of the elastic member to rotate in a direction, the major wheel may be blocked by the blocking piece and drive the winding wheel shaft to rotate; and when the major wheel rotates in a reverse direction, the major wheel may continue to rotate in the reverse direction under a restoring force of the elastic member.

The shape, number and deformation state of the limb in the present disclosure are different from those in the prior art. In the present disclosure, two directions of deformation are generated on one limb, such that the limb generates greater elastic potential energy to provide sufficient power for archery, without excessively high requirements on the toughness of the limb material. Compared with the prior art, the horizontal displacement of the limb is reduced, thereby reducing the kinetic energy consumed by the translation of the limb. In addition, as the present disclosure uses one limb, it avoids the problem of different strokes of multiple limbs in the prior art.

The limb is provided inside the frame to avoid the threat of the limb to personal safety. The winding wheels are fixed to the frame, such that the winding wheels no longer move in translation, so as to avoid the consumption of kinetic energy by the winding wheels in translation. Therefore, in the present disclosure, the arrow gains sufficient kinetic energy. According to the kinetic energy calculation formula, kinetic energy is proportional to the square of the speed, so when the kinetic energy increases, the arrow's speed increases significantly.

In addition, the present disclosure designs the winding method and the structures such as the pre-compression structure and the pre-tensioning wheels, which only need to overcome the force of the elastic member during the winding phase, rather than to overcome the deformation of the limb. Therefore, the winding process is easy and labor-saving, and avoids accidental injury to the human body caused by the limb rebounding due to insufficient tension.

DETAILED DESCRIPTION OF THE EMBODIMENTS

The present disclosure is described in further detail below with reference to the drawings and specific implementations.

Embodiment 1

Figure 1:
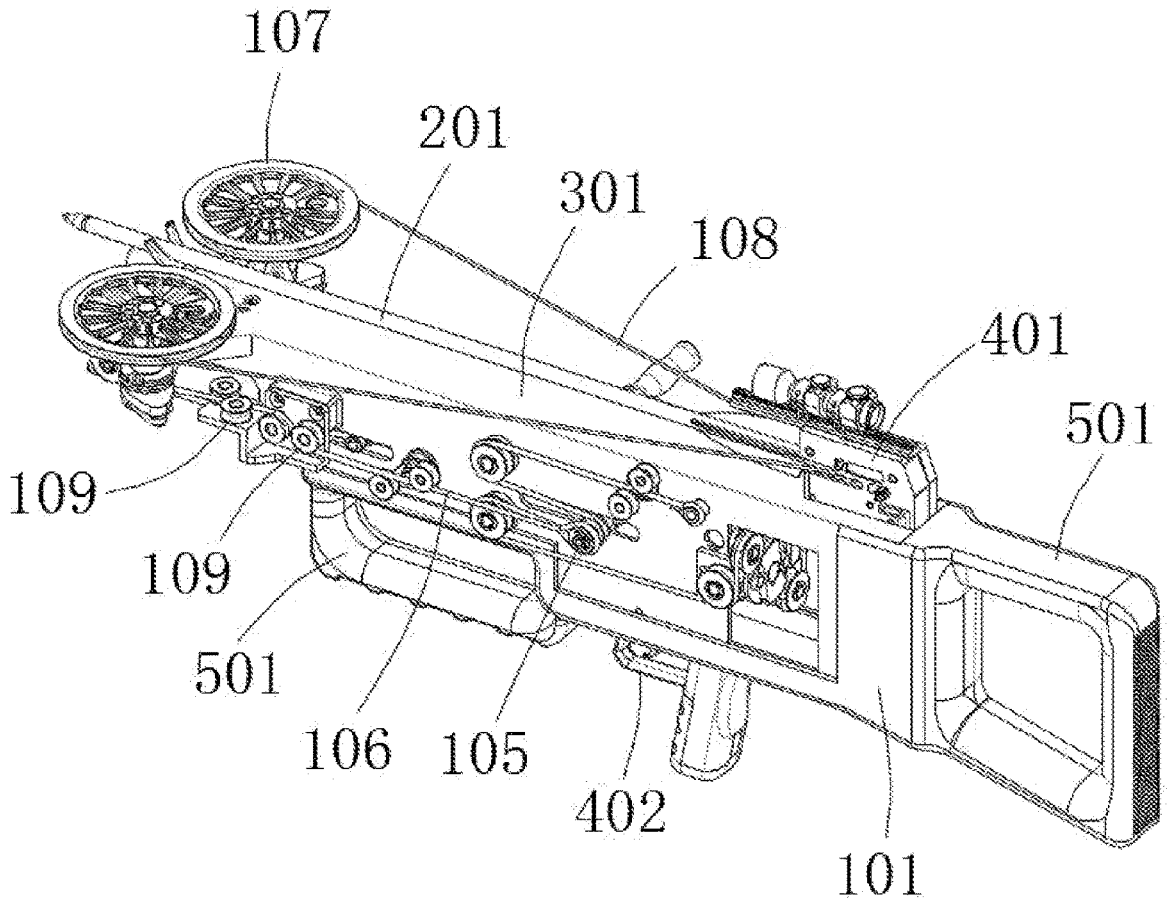
FIG. 1 is a full structural view of a crossbow according to the present disclosure.
Figure 2:
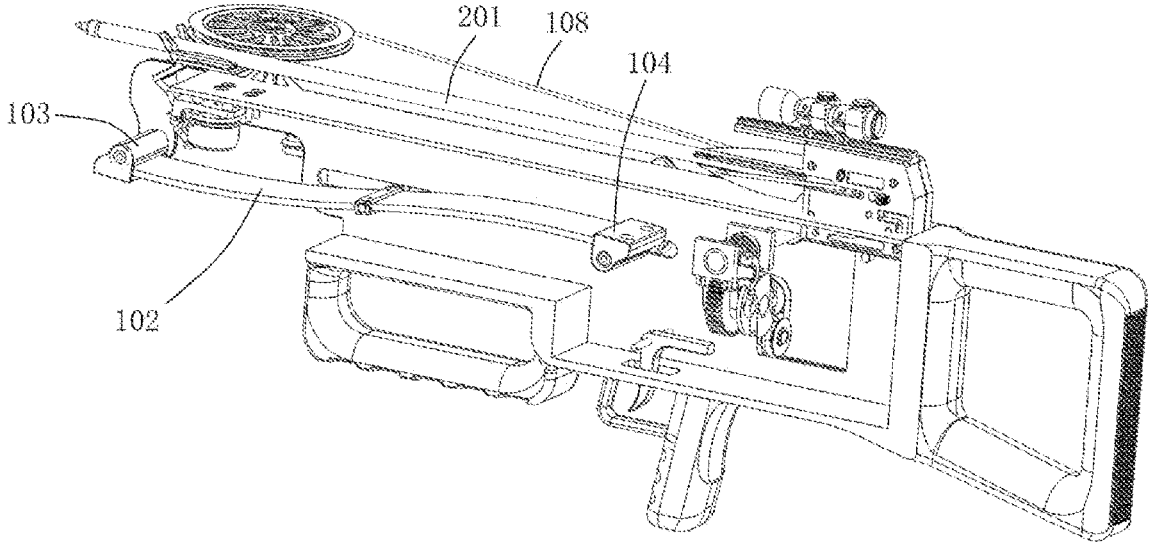
FIG. 2 is a radial sectional view of the crossbow according to the present disclosure.
Figure 3:
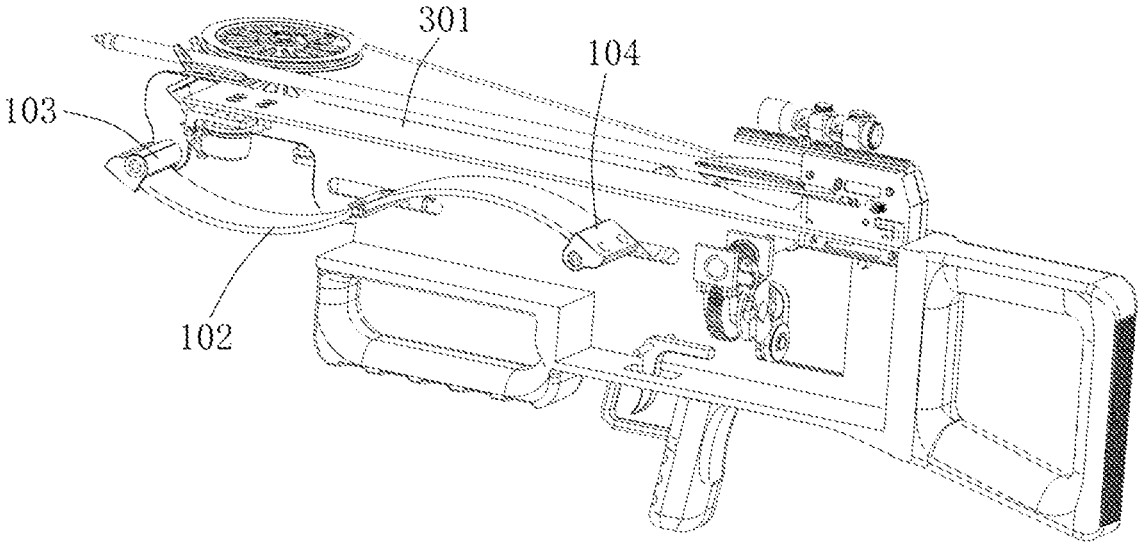
FIG. 3 is a radial sectional view of the crossbow with a limb compressed to be deformed according to the present disclosure.

As shown in FIGS. 1 to 3, a crossbow includes a frame 101. The frame 101 is provided with an arrow track 301 for placing an arrow 201. A rear end of the arrow track 301 is provided with a trigger 401. Stirrups 501 for gripping are respectively provided at corresponding positions of the frame 101. A trigger switch 402 is provided at the position of a corresponding stirrup 501. A limb 102 is provided inside the frame 101. A front end of the limb 102 is a fixed end 103 that is relatively fixed to the frame 101, and a rear end of the limb 102 is a movable end 104 that is movable relative to the frame 101. When the limb 102 is squeezed, the movable end 104 (rear end) of the limb 102 is moved forward to make the limb 102 compressed and bent.

The limb 102 includes two bent sections, namely, an upwardly bent section and a downwardly bent section. When the limb 102 is squeezed, the two bent sections are bent in opposite directions, such that the limb 102 is wave-shaped as a whole. The limb 102 squeezed into a wave shape is displaced in a direction of the arrow track 301 and generates elastic potential energy in a direction opposite to the arrow track 301.

Multiple limbs 102 may also be provided in the frame 101. For example, when there are two limbs, the two limbs are arranged vertically to avoid affecting each other's stroke. Front ends of the two limbs are fixed ends that are relatively fixed to the frame 101, and rear ends of the two limbs are relatively fixed together by a connecting piece to form a common movable end. In this way, the fixed ends, as well as the movable ends, of the two limbs are kept consistent, and the deformed states of the two limbs are kept consistent, such that the rear ends of the two limbs are movable forward to compress and bend the two limbs when squeezed.

Figure 4:
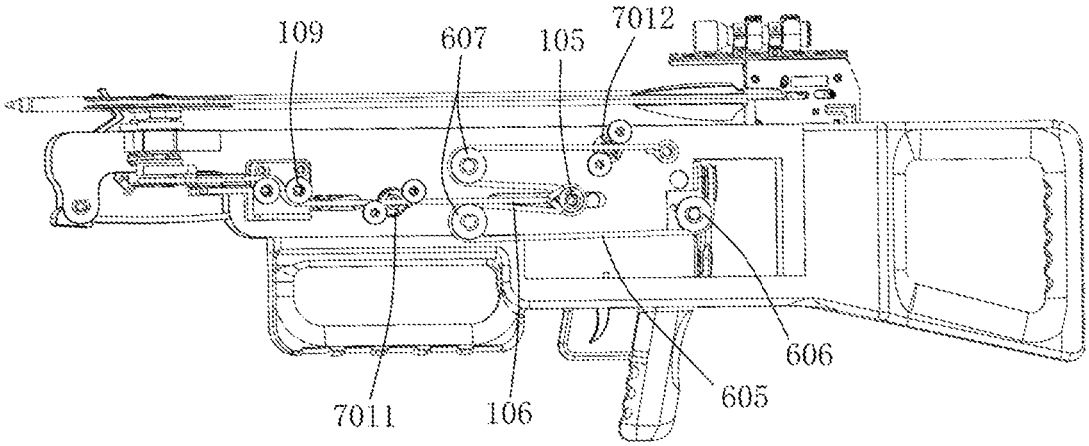
FIG. 4 is lateral structural view of the crossbow according to the present disclosure.

As shown in FIG. 4, the movable end 104 of the limb 102 extends out of the frame 101 through a connecting shaft. Double-groove pulleys 105 are respectively provided at two sides of the connecting shaft outside the frame 101. A transmission string 106 is wound and fixed on the double-groove pulleys 105.

Figure 5:
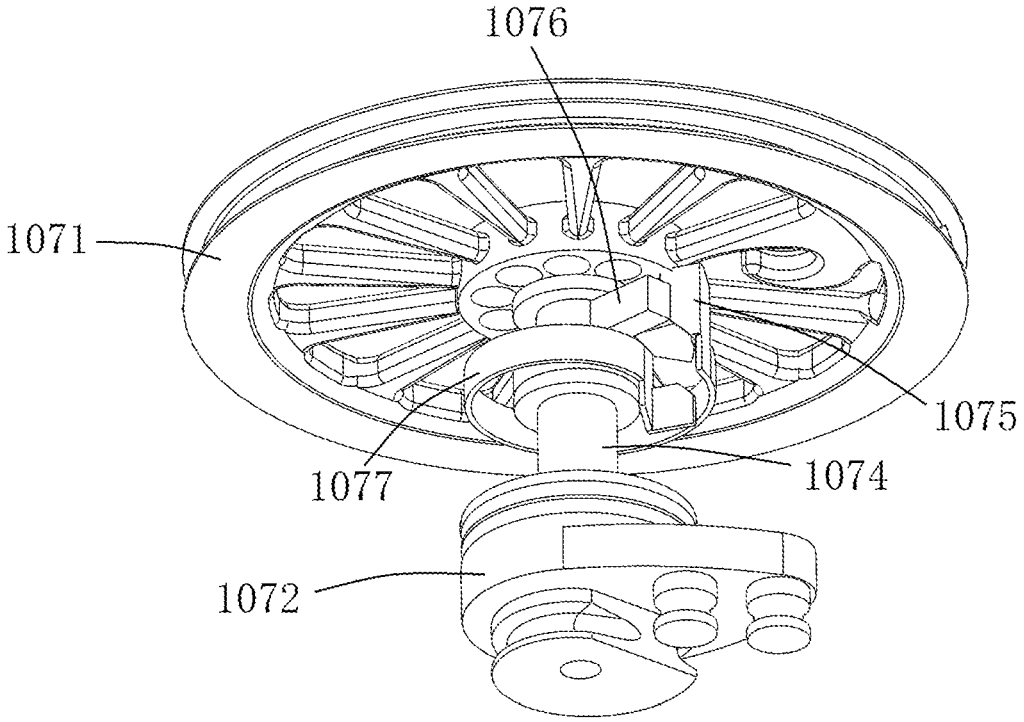
FIG. 5 is a full structural view of a winding wheel.
Figure 6:
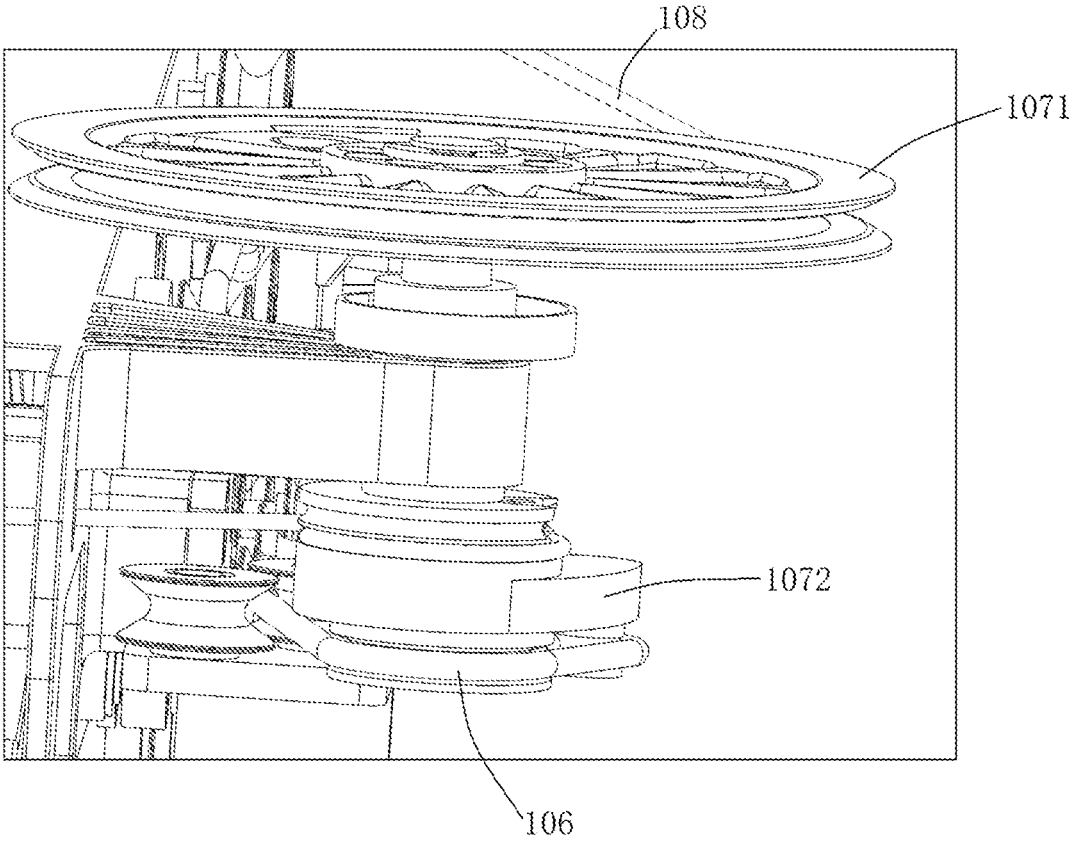
FIG. 6 is a detail structural view of the winding wheel in use on a frame.

Winding wheels 107 are symmetrically arranged at a front end of the frame 101, that is, a cocking end of the crossbow. As shown in FIGS. 1, 5 and 6, the winding wheels 107 each include a major wheel 1071 and a minor wheel 1072 that are coaxially connected. Two ends of a primary string 108 are fixed and symmetrically wound on two major wheels 1071. A middle part of the primary string 108 is pulled to clamp the primary string 108 to the trigger 401 fixed at a rear end of the frame 101.

As shown in FIGS. 5 and 6, the minor wheel 1072 is shaped like a water drop and is provided with a tip away from a winding wheel shaft. The other end of the transmission string 106 fixed on the double-groove pulleys 105 is fixedly wound on the minor wheel 1072. The special shape of the minor wheel 1072 facilitates the winding and unwinding of the transmission string 106.

A winding direction of the primary string 108 on the major wheel 1071 is opposite to that of the transmission string 106 on the minor wheel 1072.

When the trigger 401 is pressed, the trigger 401 releases the primary string 108, and the primary string 108 releases the restriction on the limb 102 at the moment of slacking. The limb 102 compressed into a wave shape restores its shape such that its movable end is moved horizontally rearward. The movable end moved rearward makes the minor wheel 1072 rotate through the transmission string 106. In FIG. 1, the minor wheel 1072 on a left side of the arrow track 301 rotates clockwise, and the minor wheel 1072 coaxial with the major wheel 1071 drives the major wheel 1071 to rotate in the same direction. The rotating major wheel 1071 drives the primary string 108 to wind around the major wheel 1071, and the primary string 108 is quickly shortened to shoot the arrow 201.

In order to stabilize the transmission of the transmission string 106, multiple positioning wheels 109 are provided on a side wall of the frame 101. As shown in FIG. 4, the multiple positioning wheels include vertical positioning wheels that rotate vertically like the double-groove pulleys 105 and transverse positioning wheels that rotate transversely like the minor wheel 1072. Starting from the minor wheel 1072, the transmission string 106 passes between two transverse positioning wheels. It is then wound on a vertical positioning wheel from above and a vertical positioning wheel from below, and finally fixedly sleeved on the double-groove pulleys 105. On the one hand, the positioning wheels 109 are used to support the transmission string 106. On the other hand, the positioning wheels 109 are also used to change the extension direction of the transmission string 106 such that the limb 102 is fit with the minor wheel 1072.

In actual use, a housing may be provided on the frame to hide the pulleys and the string on the side of the frame.

In this embodiment, the limb 102 is deformed in a vertical direction. Therefore, only a small displacement of the limb 102 in a horizontal direction is sufficient to generate kinetic energy to shoot the arrow 201. The limb 102 is hidden inside the frame 101 and will not threaten the safety of the archer. In addition, the winding wheels 107 are fixed relative to the frame 101 and will not be displaced. Therefore, the winding wheels 107 will not consume kinetic energy, thereby solving the problem that other limbs 102 and winding wheels 107 consume a lot of kinetic energy due to translation.

Embodiment 2

Figure 7:
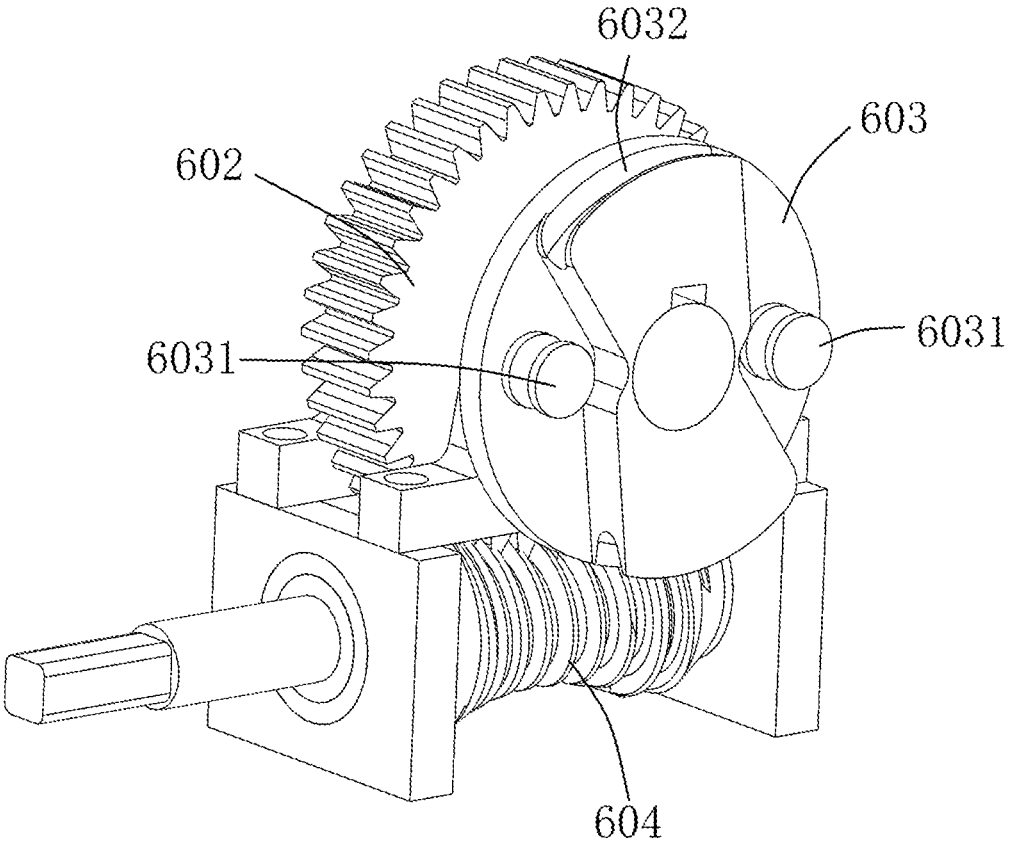
FIG. 7 is a full structural view of a pre-compression structure.

Like that in Embodiment 1, a crossbow in this embodiment includes a wave-shaped limb 102, winding wheels 107, a primary string 108, a transmission string 106 and double-groove pulleys 105. The crossbow further includes a pre-compression structure 601. As shown in FIG. 7, the pre-compression structure 601 includes a worm wheel and a worm. A worm wheel 602 is provided with a string receiving wheel 603 coaxial with the worm wheel 602, and when the worm wheel 602 rotates, the string receiving wheel 603 is driven to rotate synchronously. Two fixing posts 6031 are provided on the string receiving wheel 603. String grooves 6032 are provided on the string receiving wheel 603. Secondary strings 605 are respectively fixed to the two fixing posts 6031. When the string receiving wheel 603 rotates, the secondary strings are wound in the string grooves 6032.

Figure 8:
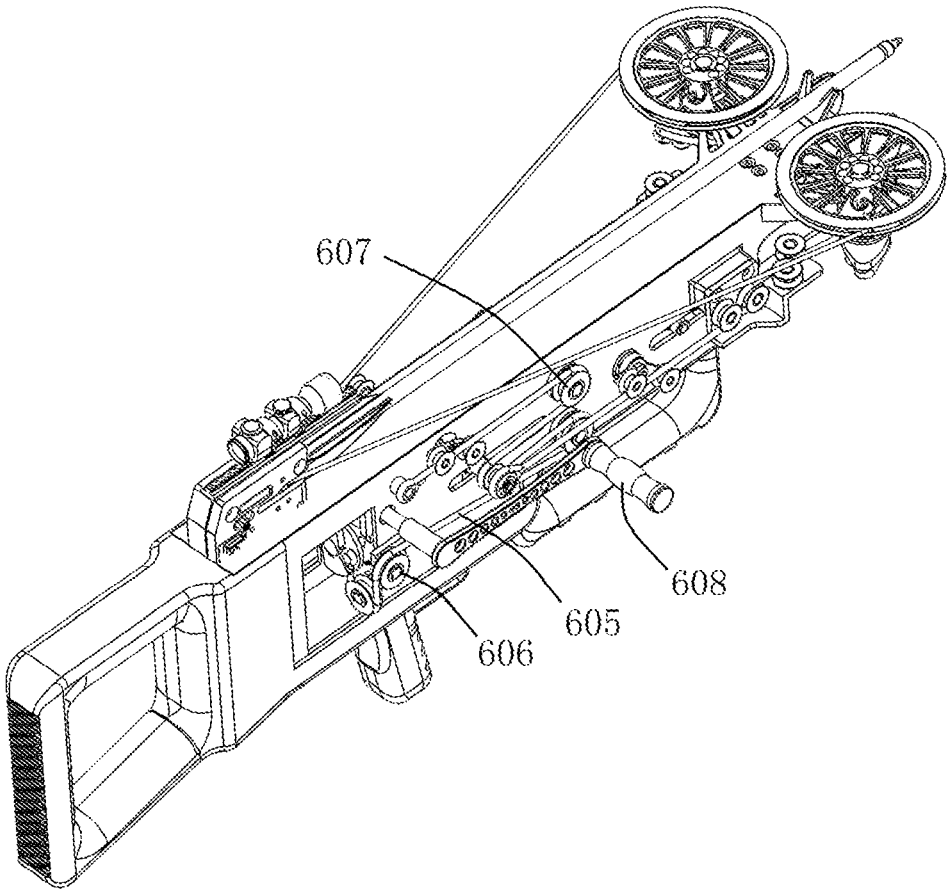
FIG. 8 is a full structural view of the crossbow from another angle according to the present disclosure.

The pre-compression structure 601 further includes multiple guide wheels 606 and multiple guide positioning wheels 607. The left and right sides of the crossbow have the same structure. As shown in FIGS. 4 and 8, the secondary strings each are tied to a fixing post 6031 on the same side. Through the guiding action of the guide wheels 606, the secondary strings are wound from a rear end of the frame 101 to a side of the frame 101. Then, the secondary strings are wound on a first guide positioning wheel 607 from below and then turn to be wound on the double-groove pulleys 105 from below. Further, the secondary strings leave from above the double-groove pulleys 105. They are wound on a second guide positioning wheel 607 from below and turn to be fixed to corresponding sides of the frame 101 by the fixing posts 6031. In this way, the two guide positioning wheels 607 define two fixed pulleys, and the double-groove pulleys 105 in the middle define movable pulleys. When the string receiving wheel 603 rotates to tighten the secondary strings, the secondary strings pull the double-groove pulleys 105 to move forward. The double-groove pulleys 105 are relatively fixed to a movable end of the limb 102, thereby compressing the limb 102.

A handle 608 connected to a worm 604 is provided outside the frame 101. Rotating the handle can realize the rotation of the worm, thereby further driving the worm wheel 602 and the string receiving wheel 603 to rotate. After the winding of the strings is completed, the worm wheel and the worm locks to maintain the state of the strings.

In this embodiment, the first guide wheel 606 is coplanar with the string receiving wheel 603, and both rotate in a vertical direction perpendicular to a direction of the arrow track 301. The second guide wheel 606 rotates in a vertical direction parallel to the direction of the arrow track 301 (parallel to the side of the frame 101). Starting from the fixing posts 6031, the he secondary strings are wound on the first guide wheel 606 from below, and then are wound around the second guide wheel 606 from above. In this way, the secondary strings are guided from the rear end of the frame 101 to the sides of the frame 101 by the guide wheels 606.

Embodiment 3

Like that in Embodiment 1, a crossbow in this embodiment includes a wave-shaped limb 102, winding wheels 107, a primary string 108 and a transmission string 106. The crossbow further includes the pre-compression structure 601 mentioned in Embodiment 2. In addition, the crossbow in this embodiment further includes pre-tensioning wheels 701.

Figure 9:
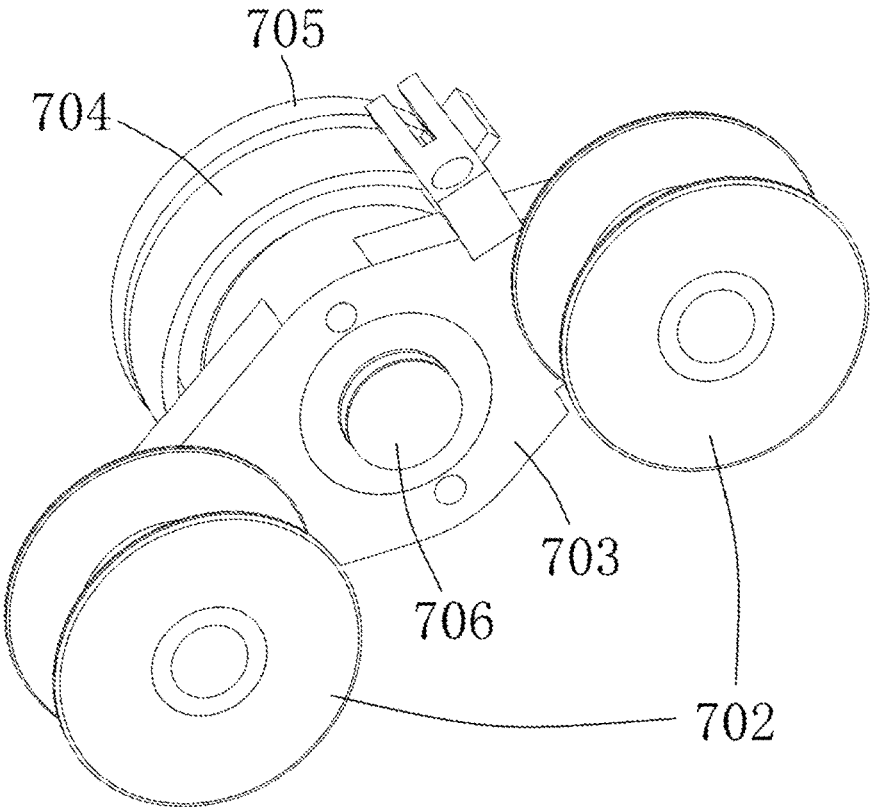
FIG. 9 is a full structural view of a pre-tensioning wheel.
Figure 10:
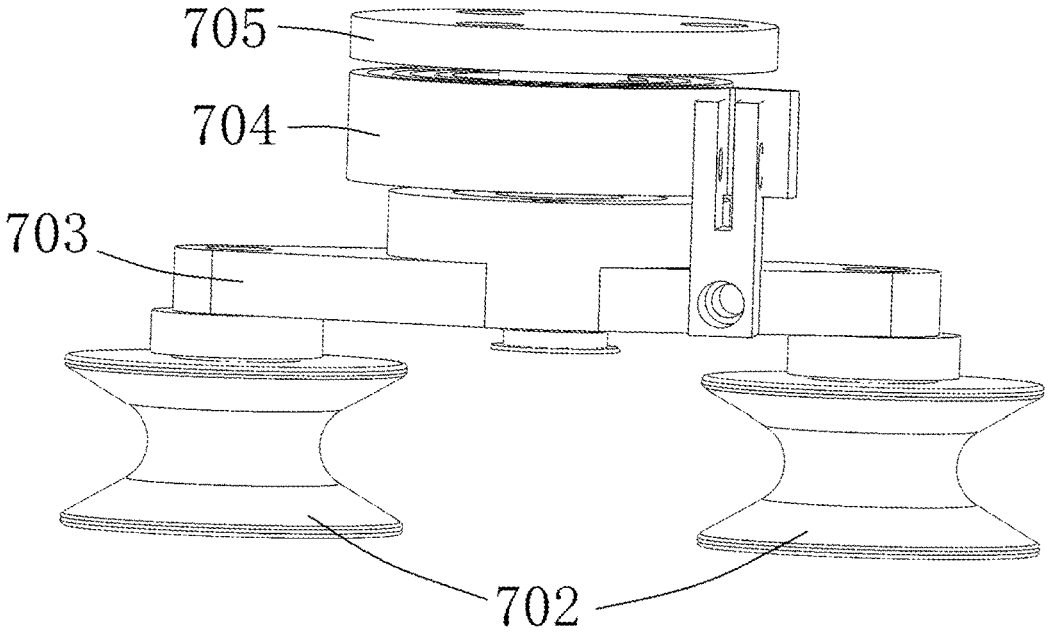
FIG. 10 is lateral structural view of the pre-tensioning wheel.

As shown in FIGS. 9 and 10, the pre-tensioning wheels 701 each include two or more guide pulleys 702, a support 703 connecting the guide pulleys 702, an elastic member 704, a support base 705 and a central shaft 706. The pre-tensioning wheels 701 are provided on paths of the secondary string and the transmission string 106 on the side of the frame 101. Specifically, the support base 705 is fixed to the frame 101. The support base 705 is connected to the support 703 in a rotating manner through the central shaft 706. The two or more guide pulleys 702 are arranged on the support 703. The support 703 and the support base 705 are connected through the elastic member 704. In this embodiment, the elastic member 704 is a torsion spring.

In this embodiment, preferably, there are two, three, four or more guide pulleys 702. In this embodiment, the number of guide pulleys 702 is not limited so long as a pre-tensioning effect can be achieved.

When in use, the pre-tensioning wheel 701 is rotated in advance in a direction opposite to the torsion spring to generate a pre-tensioning force on the pre-tensioning wheel 701. The pre-tensioning wheel 701 with the pre-tensioning force is placed on the path of the transmission string 106. As shown in FIG. 4, the transmission string 106 is put on the guide pulleys 702. When the transmission string 106 is slack, the pre-tensioning wheel 701 drives the support 703 to rotate under the action of the torsion spring, such that the transmission string 106 is wound on the multiple guide pulleys 702. When provided on the path of the secondary string, the pre-tensioning wheel 701 also has the same effect. In this embodiment, multiple wheels are used. In order to prevent the string from detaching from the wheels, the pre-tensioning wheel 701 tightens the slack string.

The crossbow is operated as follows:

To wind the string, the handle is turned to make the pre-compression structure 601 tighten the secondary string. The tightened secondary string pulls the double-groove pulleys 105 forward. Since the double-groove pulleys 105 are fixed to the movable end of the limb 102, they drive the movable end of the limb 102 to move forward, so as to make the limb 102 compressed.

Since the transmission string 106 is fixed to the double-groove pulleys 105, when the double-groove pulleys 105 move forward, the transmission string 106 is also driven to move forward. As shown in FIG. 4, during this process, the transmission string 106 is slack, and a pre-tensioning wheel A7011 on the path of the transmission string 106 winds the transmission string 106 and keeps the transmission string 106 straight to prevent the transmission string 106 from detaching from the positioning wheel 109.

Further, manually or in other ways, the middle part of the primary string 108 is pulled to the trigger 401 and hooked on the trigger 401. Pulled by the primary string 108, the major wheels 1071 and the minor wheels 1072 of the winding wheel 107 rotate in the same direction. Taking the winding wheel 107 on the left side of the arrow track 301 as an example, the major wheel 1071 and the minor wheel 1072 rotate counterclockwise. Therefore, the transmission string 106 is wound on the minor wheel 1072, such that the transmission string 106 is pulled forward. Due to this force, the pre-tensioning wheel A7011 wound with the transmission string 106 is rotated in opposite to the torsion spring to release the transmission string 106.

In this process, the force of the limb 102 is always on the secondary string, not on the transmission string 106. Therefore, the pulling of the primary string 108 only needs to overcome the force generated by the pre-tensioning wheel A7011 and the winding wheels 107, such that the primary string 108 can be connected to the trigger 401 with less effort.

Then, the arrow 201 is placed in the arrow track 301.

When it is ready for shooting, the handle is turned in a reverse direction to slack the secondary string, thereby releasing the force of the limb 102 on the secondary string. The force of the limb 102 naturally all acts on the transmission string 106, the primary string 108 and the trigger 401. A pre-tensioning wheel B7012 on the secondary string path can tighten the slack secondary string and prevent the secondary string from detaching.

The handle is continuously turned in the reverse direction until the secondary string wound on the pre-tensioning wheel B7012 has a sufficient length for the double-groove pulleys 105 to move for a distance when the limb 102 rebounds. Then it's time to aim and pull the trigger 401.

When the trigger 401 is released, the limb 102 is free from the restriction of the transmission string 106 and rebounds quickly. The rebounding limb 102 pulls the transmission string 106, such that the primary string 108 is quickly wound on the winding wheels 107 to shoot the arrow 201.

Embodiment 4

Figure 11:
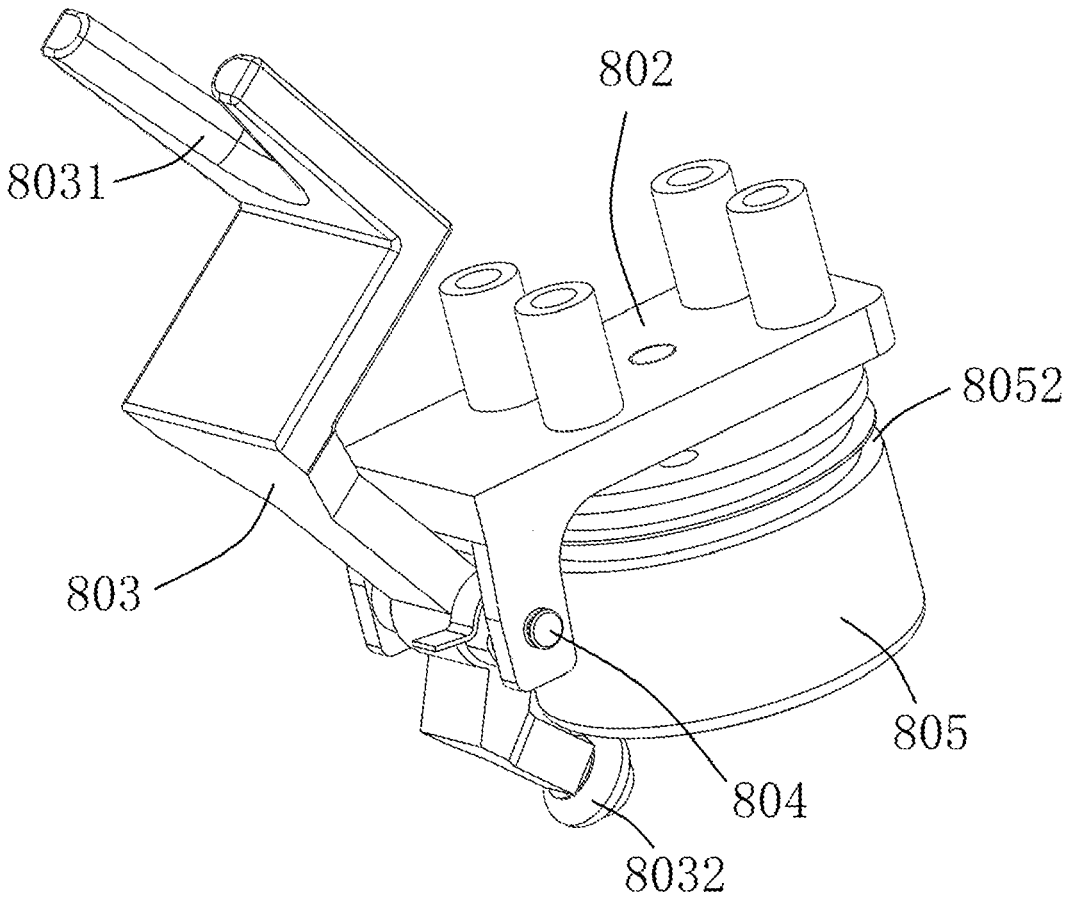
FIG. 11 is a full structural view of a height-adjustable arrow rest.
Figure 12:
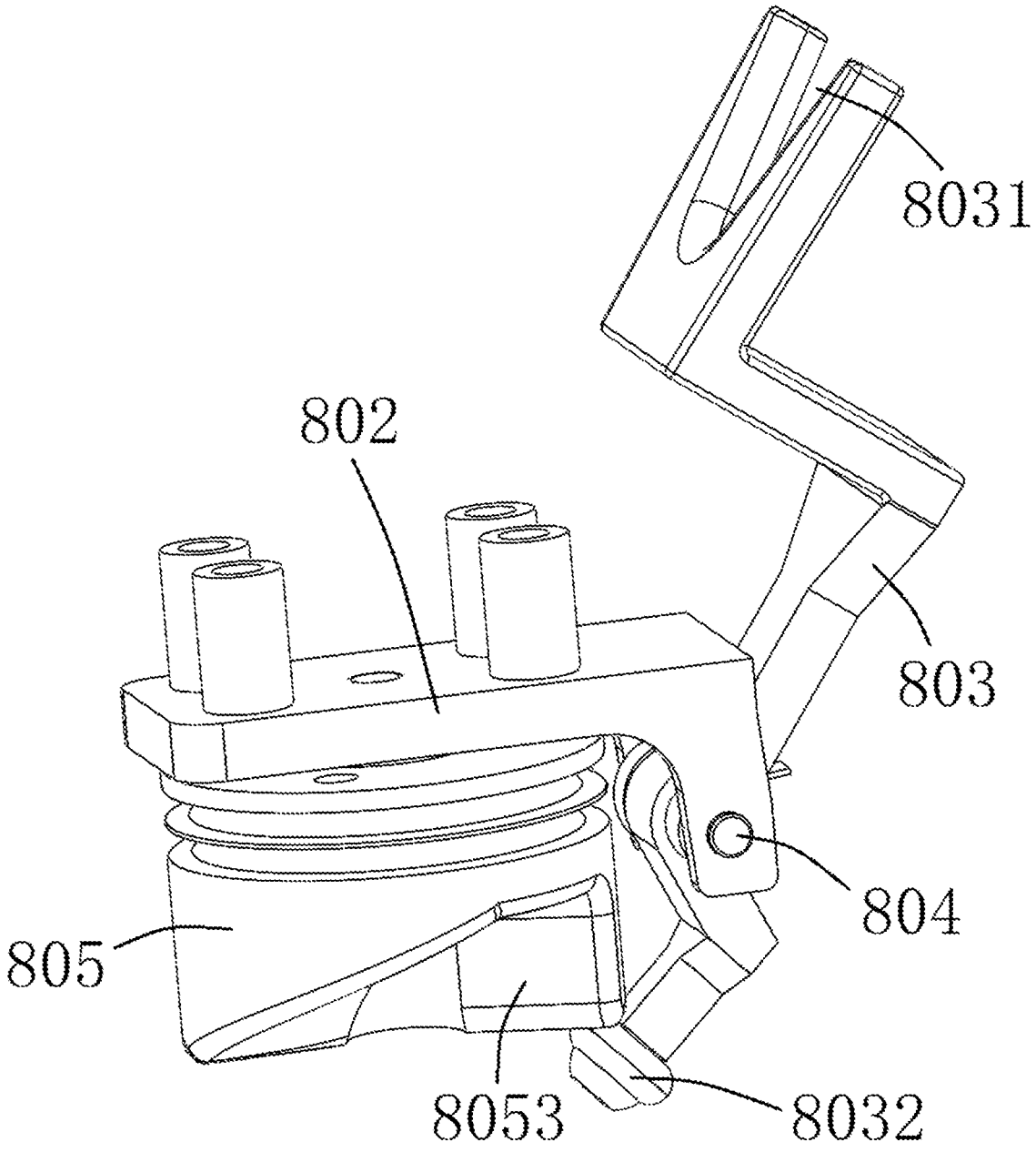
FIG. 12 is a full structural view of the height-adjustable arrow rest from another angle.
Figure 13:
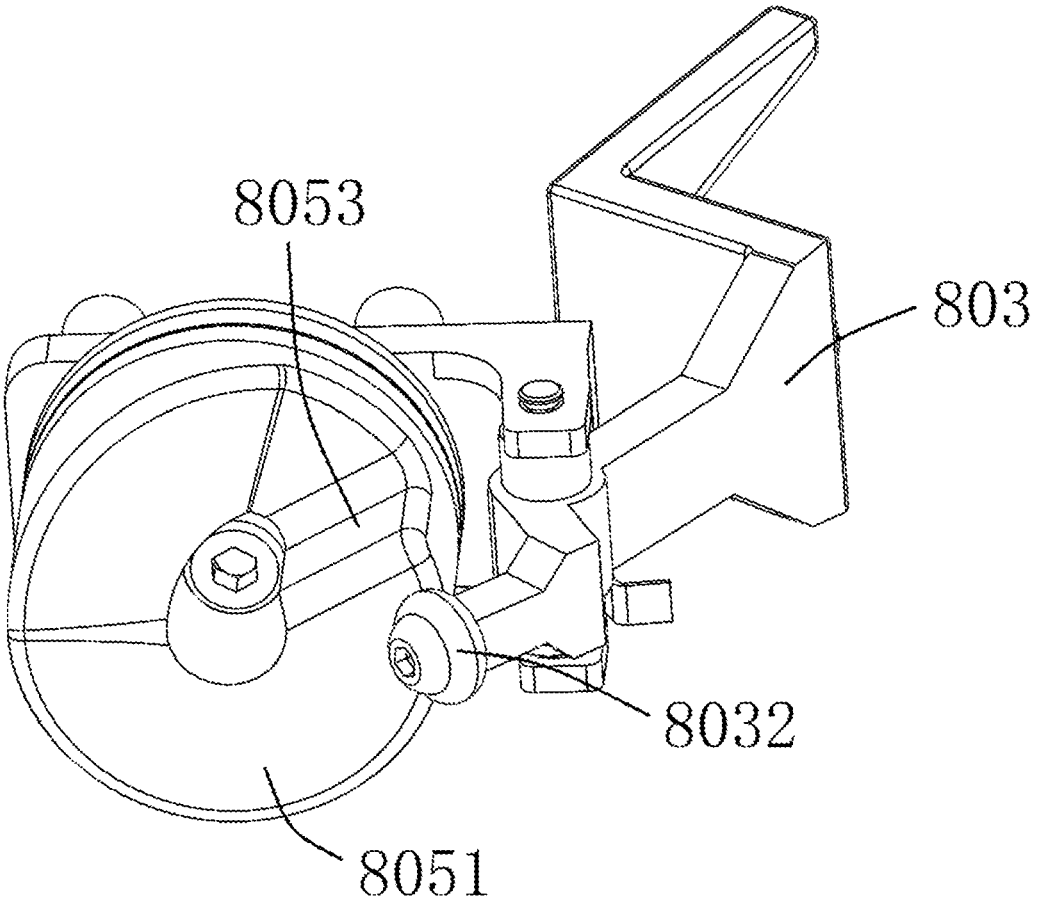
FIG. 13 is a bottom view of the height-adjustable arrow rest.

Like that in Embodiment 1, a crossbow in this embodiment includes a wave-shaped limb 102, winding wheels 107, a primary string 108 and a transmission string 106. The crossbow further includes a height-adjustable arrow rest 801. The height-adjustable arrow rest 801 is provided at the shooting end of the crossbow and located between the two winding wheels 107. As shown in FIGS. 11 to 13, the height-adjustable arrow rest 801 includes an arrow rest stand 802 and an arrowhead bracket 803. The arrow rest stand 802 is fixed below the arrow track 301 inside the frame 101.

Figure 14:
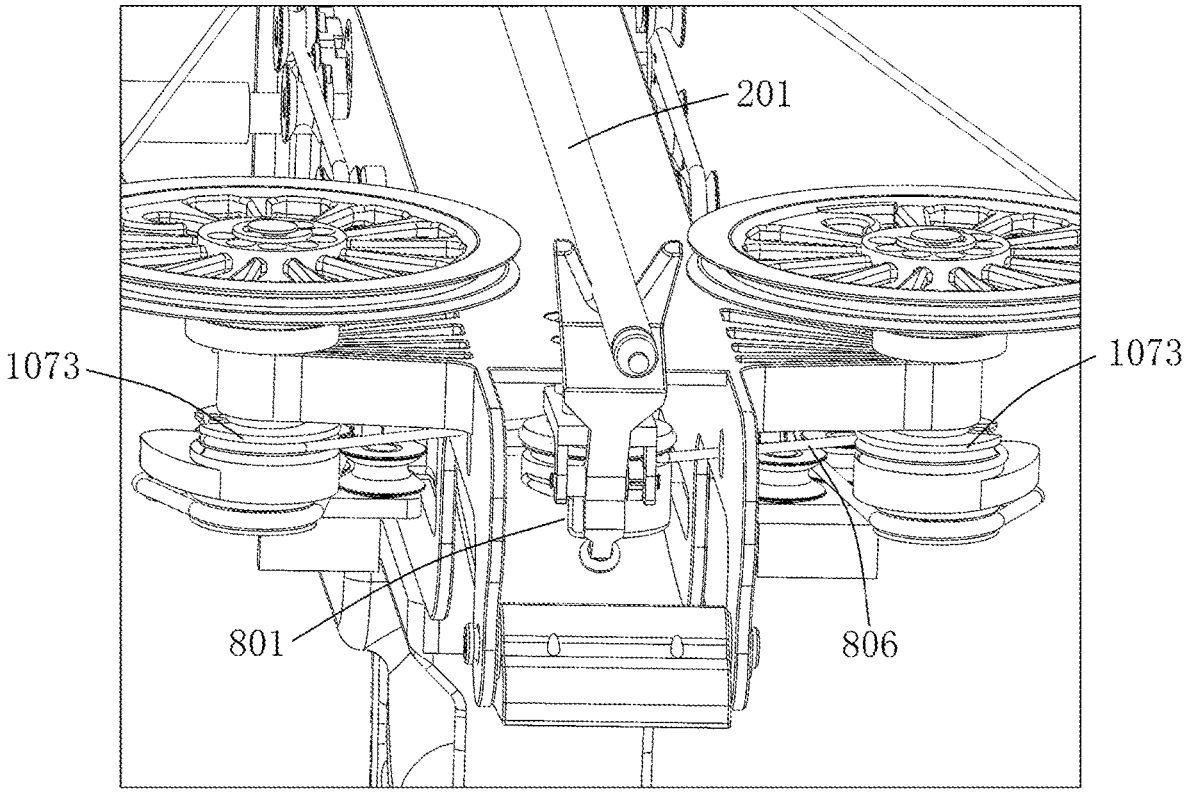
FIG. 14 is a detail structural view of the height-adjustable arrow rest in use on the frame.

A pivot point 804 is provided in a middle part of the arrowhead bracket 803. The arrowhead bracket 803 is pivotally connected to the arrow rest stand 802 through the pivot point 804, such that the arrowhead bracket 803 is rotatable vertically around the pivot point 804. The arrowhead bracket 803 rotates in a first direction (upward) to position an arrow groove in the arrow track 301, and the arrowhead bracket 803 rotates in a second direction (downward) to move the arrow groove away from the arrow track 301, as shown in FIG. 14.

The arrowhead bracket 803 above the pivot point 804 is in a Z-shape. In the direction (upward) close to the arrow track 301, the arrowhead bracket 803 is provided with the arrow groove 8031 for an arrow 201 to pass through. In the direction (downward) of the pivot position 804 away from the arrow track 301, the arrowhead bracket 803 is in an L shape bent rearward. A lower end of the arrowhead bracket 803 defines a rotatable tip 8032.

The arrow groove is located in the arrow track 301 to support the arrow 201. However, when the arrow 201 is shot, the arrow groove will interfere with an arrow fletching. Therefore, it is necessary to drop the arrow groove to prevent the arrow groove from scratching the arrow fletching.

A horizontally rotating take-up wheel 805 is provided below the arrow rest stand 802. A bottom surface of the take-up wheel 805 is provided with a slide 8051 that spirals upward or downward around a center of the bottom surface. The tip 8032 at the lower end of the arrowhead bracket 803 abuts against the slide 8051 on the bottom surface of the take-up wheel 805 via a spring. When the take-up wheel 805 rotates, the tip 8032 slides along the spiral slide 8051. As the sliding position of the tip 8032 changes, the tip 8032 changes in height with the height of the slide 8051 during the sliding process, further taking the pivot point 804 as a fulcrum. When the tip 8032 rises, the arrow groove falls away from the arrow track 301. When the tip 8032 falls, the arrow groove rises into the arrow track 301.

A wall 8053 is formed between a lowest point and a highest point of the slide 8051 located on the bottom surface of the take-up wheel 805. When the tip 8032 slides to the lowest point of the slide 8051, the wall 8053 plays a blocking role, such that the tip 8032 can only slide one circle around the slide 8051 and then can only slide in a reverse direction.

As shown in FIG. 14, the take-up wheel 805 is provided with two take-up grooves 8052 coaxially. The winding wheels 107 on both sides of the take-up wheel 805 are respectively provided with winding grooves 1073 corresponding to the take-up grooves 8052. The winding grooves 1073 may be respectively integrally formed with the minor wheels 1072. The winding grooves 1073 have the same height as the corresponding take-up grooves 8052, which is convenient for winding arrow rest control strings 806 on the corresponding winding grooves 1073 and the take-up grooves 8052. In this way, the arrow rest control strings 806 are wound in the two take-up grooves 8052, respectively. The other ends of the arrow rest control strings 806 are wound on the corresponding winding grooves 1073. The winding directions of the arrow rest control strings 806 in the two take-up grooves 8052 are opposite. For example, when the arrow rest control string 806 in an upper take-up groove 8052 is wound clockwise, the arrow rest control string 806 in a lower take-up groove 8052 is wound counterclockwise.

When the winding wheels 107 rotate, they synchronously drive one arrow rest control string 806 to be taken up and the other arrow rest control string 806 to be unwound, thereby generating a rotational driving force on the take-up wheel 805. Adapted to the changes in the directions of rotation of the winding wheels 107 in the winding and shooting phases, the take-up wheel 805 rotates in different directions synchronously, such that the arrow groove rises during winding and falls after shooting.

Embodiment 5

Figure 15:
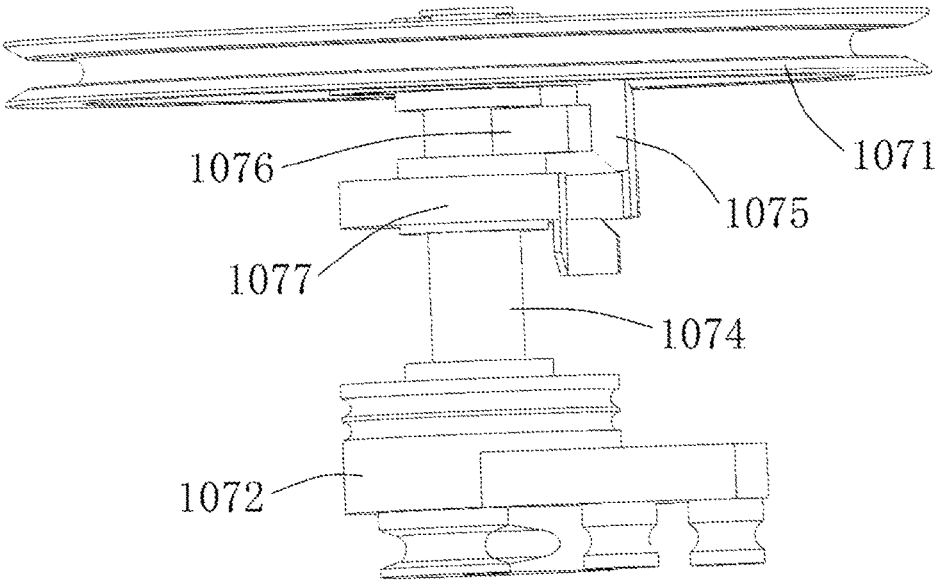
FIG. 15 is lateral structural view of the winding wheel.

Like that in Embodiment 1, a crossbow in this embodiment includes a wave-shaped limb 102, winding wheels 107, a primary string 108 and a transmission string 106. The winding wheels 107 each include a major wheel 1071 and a minor wheel 1072, and the major wheel 1071 and the minor wheel 1072 are connected through a winding wheel shaft 1074. As shown in FIGS. 5 and 15, the minor wheel 1072 is fixed to the winding wheel shaft 1074. A blocking seat 1075 is axially fixed at one end of the winding wheel shaft 1074 provided with the major wheel 1071. The major wheel 1071 is axially fixed with a blocking piece 1076. The blocking piece 1076 is located on a back surface of the blocking seat 1075. The blocking piece 1076 and the blocking seat 1075 are fixed through an elastic member, that is, a torsion spring 1077. One end of the torsion spring 1077 is fixed to the major wheel 1071, and the other end thereof is fixed to the winding wheel shaft 1074.

In the winding phase, the primary string 108 drives the major wheel 1071 to rotate. The major wheel 1071 rotates in a direction, such that the blocking piece 1076 rotates from the back surface of the blocking seat 1075 to a front surface of the blocking seat 1075. The major wheel 1071 continues to rotate in the same direction. The blocking piece 1076 is blocked by the blocking seat 1075, and the blocking piece 1076 drives the blocking seat 1075 to rotate together. In this way, the rotation of the major wheel 1071 is transmitted to the winding wheel shaft 1074, and then to the minor wheel 1072 to drive the minor wheel 1072 to rotate together.

In the shooting phase, the limb 102 rebounds to drive the minor wheel 1072 and the winding wheel shaft 1074 to rotate in the reverse direction, such that the blocking seat 1075 drives the blocking piece 1076 to rotate in the reverse direction. Under natural circumstances, when the minor wheel 1072 rotates to an extreme position, the minor wheel 1072 cannot continue to exert force to the major wheel 1071, and the arrow 201 is shot away from the primary string 108. At this time, the rotation speed of the major wheel 1071 is the fastest, and the kinetic energy generated by the rotation of the major wheel 1071 is the greatest. Since the arrow 201 leaves the primary string 108, the primary string 108 no longer exerts force on the arrow 201. Therefore, the kinetic energy generated by the major wheel can only be absorbed through its own shock absorption and released through noise, so as to avoid waste of kinetic energy and avoid large noise.

In this embodiment, the stroke of the arrow 201 can be extended by extending the primary string 108. When the minor wheel 1072 cannot continue to drive the major wheel 1071 to rotate, the force of the torsion spring 1077 to restore the shape makes the major wheel 1071 continue to rotate. This prevents the major wheel 1071 from abruptly stopping at the fastest speed to cause a waste of kinetic energy. The kinetic energy generated by the rotation of the major wheel 1071 continues to be transmitted to the arrow 201, thereby increasing the speed of the arrow 201. The major wheel 1071 has at least one circle of kinetic energy utilized, and at least one circle of kinetic energy wasted, which correspondingly reduces noise.

It should be noted that the above described examples are not intended to limit the present disclosure, and the present disclosure is not limited thereto. Changes, modifications, additions or replacements made by those skilled in the art based on the technical solutions of the present disclosure should fall within the protection scope of the present disclosure.

What is claimed is:

1. A crossbow, comprising a frame, wherein the frame is provided with an arrow track for placing an arrow;

the crossbow comprises at least one limb; and the at least one limb comprises a fixed end and a movable end;

when the movable end is moved toward the fixed end under pressure, the at least one limb is wave-shaped by forming two sections bent in opposite directions on the at least one limb;

when the movable end is moved in a reverse direction, the at least one limb restores; and a primary string of the crossbow is directly or indirectly connected to the movable end of the at least one limb.

2. The crossbow according to claim 1, wherein winding wheels are symmetrically arranged on left and right sides of the arrow track.

3. The crossbow according to claim 2, wherein the winding wheels are connected to the movable end of the at least one limb through a transmission string.

4. The crossbow according to claim 3, wherein the transmission string is connected to the primary string through the winding wheels; and a winding direction of the transmission string on the winding wheels is opposite to a winding direction of the primary string on the winding wheels.

5. The crossbow according to claim 2, wherein a blocking piece is provided between a major wheel and a winding wheel shaft of each of the winding wheels.

6. The crossbow according to claim 5, wherein when the major wheel rotates in a direction, the major wheel is blocked by the blocking piece and drives the winding wheel shaft to rotate.

7. The crossbow according to claim 6, wherein an elastic member is further provided between the major wheel and the winding wheel shaft of each of the winding wheels.

8. The crossbow according to claim 7, wherein when the major wheel overcomes a force of the elastic member to rotate in a direction, the major wheel is blocked by the blocking piece and drives the winding wheel shaft to rotate; and when the major wheel rotates in a reverse direction, the major wheel continues to rotate in the reverse direction under a restoring force of the elastic member.

9. The crossbow according to claim 1, wherein the crossbow is provided with a pre-compression structure; and the pre-compression structure comprises a worm wheel and a worm; and a string receiving wheel is fixed coaxially with the worm wheel.

10. The crossbow according to claim 9, wherein a first end of a secondary string is wound on the string receiving wheel;

a second end of the secondary string is wound on a guide wheel and the movable end of the at least one limb and then is fixed, and the movable end of the at least one limb defines a movable pulley structure; and when the secondary string is tightened, the movable end of the at least one limb is driven to move toward the fixed end.

11. The crossbow according to claim 1, wherein the crossbow is provided with a pre-tensioning wheel; and the pre-tensioning wheel comprises a central shaft and at least two guide pulleys; and the at least two guide pulleys revolve around the central shaft.

12. The crossbow according to claim 11, wherein an elastic member is provided on the central shaft; and the pre-tensioning wheel is rotated in a reverse direction to generate a restoring force on the elastic member, and the restoring force pre-tensions a transmission string and a secondary string.

13. The crossbow according to claim 11, wherein the pre-tensioning wheel is located on paths of a transmission string and a secondary string.

14. The crossbow according to claim 1, wherein a height-adjustable arrow rest is provided at an exit of the arrow track of the crossbow.

15. The crossbow according to claim 14, wherein the height-adjustable arrow rest comprises an arrowhead bracket; and the arrowhead bracket is provided with an arrow groove in a direction close to the arrow track.

16. The crossbow according to claim 15, wherein the arrowhead bracket rotates vertically with a middle part of the arrowhead bracket as a fulcrum; and the arrowhead bracket rotates in a first direction to position the arrow groove in the arrow track, and the arrowhead bracket rotates in a second direction to make the arrow groove move away from the arrow track.

17. The crossbow according to claim 15, wherein the height-adjustable arrow rest further comprises a take-up wheel; and the take-up wheel is fixed relative to the arrow track;

the take-up wheel is rotatable; and a surface of the take-up wheel is provided with a slide, and the slide spirals upward or downward around a center of the surface.

18. The crossbow according to claim 17, wherein in a direction away from the arrow track, the arrowhead bracket is provided with a rotatable tip extending to the slide; and the tip abuts against the slide and slides along the slide; and when the take-up wheel rotates, the tip rises or falls along the slide, and the arrow groove of the arrowhead bracket moves away from the arrow track or moves toward the arrow track.

19. The crossbow according to claim 18, wherein the take-up wheel is provided with two arrow rest control strings, and the two arrow rest control strings are respectively wound on the winding wheels on two sides.

20. The crossbow according to claim 19, wherein winding directions of the two arrow rest control strings on the take-up wheel are opposite; and when the two winding wheels rotate relative to each other, the two arrow rest control strings drive the take-up wheel to rotate.

* * * * *